United States Patent [19]

Walton

[11] 4,159,578

[45] Jul. 3, 1979

[54] DRYING OVEN

[76] Inventor: Ronald D. Walton, 5480 Dickens Dr., Baton Rouge, La. 70812

[21] Appl. No.: 853,579

[22] Filed: Nov. 21, 1977

[51] Int. Cl.[2] ..... F26B 11/02

[52] U.S. Cl. ..... 34/344; 34/184

[58] Field of Search ..... 34/132, 133, 235, 50, 34/54, 108, 109, 184, 185, 186, 187, 188, 34

[56] References Cited

U.S. PATENT DOCUMENTS

| | | | |
|---|---|---|---|
| 552,667 | 1/1896 | Mote | 34/187 |
| 1,539,778 | 5/1925 | Selph | 34/187 |
| 1,759,179 | 5/1930 | Wiesman | 34/187 X |
| 3,016,627 | 1/1962 | Freund | 34/187 |
| 3,525,161 | 8/1970 | Jesperson | 34/187 X |

*Primary Examiner*—George H. Krizmanich

*Attorney, Agent, or Firm*—Edgar E. Spielman, Jr.; David L. Ray

[57] ABSTRACT

A drying oven for drying materials which give off noxious fumes is disclosed. The drying oven comprises a drying chamber having a circular top wall and a downwardly depending sidewall which is closed off at its bottom by a bottom wall. The circular top wall has an exhaust port which is eccentric therewith. The sidewall has means for introducing dry gas into the drying chamber through an intake port which is located directly beneath the exhaust port. A doorway is also provided for allowing the introduction of the material to be dried into the exhaust chamber. There is no requirement that the doorway have elaborate pressure seals as the pressures within the chamber do not rise appreciably above ambient pressures due to the unique location of the exhaust port with reference to the location of the introduction of the dry air.

3 Claims, 5 Drawing Figures

DRYING OVEN

BACKGROUND OF THE INVENTION

The drying of materials which give off noxious fumes such as hydrogen cyanide, hydrofluoric acid, etc. is a problem often encountered in the chemical laboratory. Heretofore such drying has been accomplished in very expensive drying chambers having doors with very elaborate sealing systems to prevent gas leakage caused by positive pressure buildup within the drying chamber. Not only are these prior art drying chambers expensive, they are also subject to breakdown due to the complexity of the sealing systems required.

Therefore it is an object of this invention to provide a drying chamber for handling noxious substances which does not require a door having elaborate sealing systems to prevent leakage of noxious gases from the chambers due to buildup of positive pressures within the chamber.

THE INVENTION

This invention relates to an apparatus for drying material which apparatus comprises a drying chamber which includes (i) a circular planar top wall having an eccentric exhaust port, (ii) an annular sidewall downwardly depending from the top wall, the annular sidewall having an intake port located at a point beneath the exhaust port and the annular sidewall having an openable and closable doorway for introducing the material to the drying chamber and (iii) a circular, planar bottom wall closing off the bottom of the annular sidewall; holding means enclosed within the drying chamber for holding the material up off of the bottom wall; means for introducing dry gas to the interior of the drying chamber through the intake port; and conduit means for routing exhaust gas from the drying chamber through the exhaust port to a disposal site.

To provide the highest quality of drying with the drying chamber of this invention it has been found preferable that the holding means be a rotating table which is driven by an electric motor exterior to the chamber which motor drives a spindle connected to the table and passing through the bottom wall of the chamber. When this rotating table is used, the material placed on the table will pass directly in front of the incoming dry gas. Since the table is constantly rotating, all material in the chamber will have equal exposure to the drying gas. It has also been found preferable that the ratio of the diameter of the chamber to the diameter of the diameter of the exhaust port be within the range of from about 1.8:7 to about 2.2:8.5. By utilizing a ratio within this range it is assured that positive pressures within the chamber will be minimal.

The means for introducing dry gas to the chamber can be any conventional blower fan which is connected to the intake port. In some instances it may be desirable to have a heating element in the blower fan to provide warm air to the chamber. It is to be understood, of course, that the blower fan has to be sized to the drying chamber. Blower fans which have high air flow capacity will not be suitable for chambers which cannot handle the exhaust without causing a positive pressure within the chamber. Sizing of the blower fan is easily determinable by one skilled in the art. It has been found, for example, for a chamber in which the chamber diameter is about 14 inches and the exhaust port is about six inches that a blower fan providing a flow rate of 35 cubic feet perminute is suitable and will not cause appreciable positive chamber pressures. Despite this limitation in blower size, it has been found that the unique configuration of the drying chamber of this invention allows for the utilization of blowers having a larger capacity than would be possible with drying chambers having other configurations.

These and other features of this invention contributing satisfaction in use and economy in manufacture may be more fully understood from the following description of a preferred embodiment of the invention when taken in connection with the accompanying drawings, in which identical numerals refer to identical parts and in which.

Figure 2:
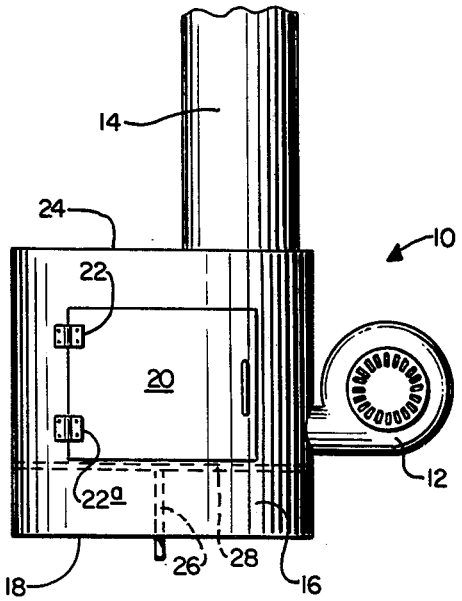
FIG. 2 is a front elevational view of the drying chamber shown in FIG. 1.
Figure 3:
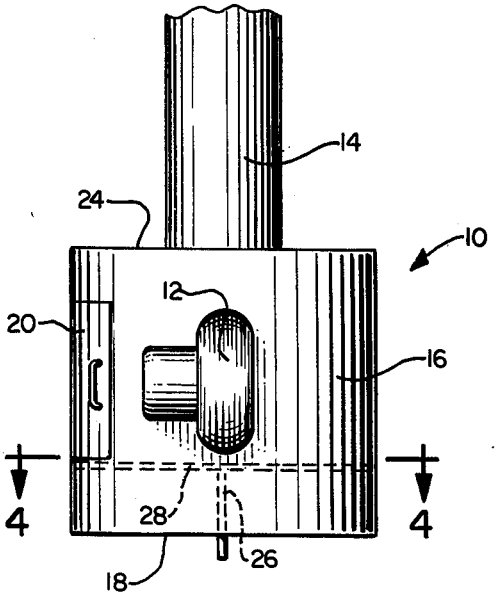
FIG. 3 is a side elevational view of the drying chamber shown in FIG. 1.

Referring now to FIGS. 1–5, it can be seen that a drying chamber of this invention, generally designated by the numeral 10, has a top wall 24, an annular downwardly depending sidewall 16 and a bottom wall 18. Attached to top wall 24 is exhaust pipe 14 which is congruent with exhaust port 15 shown in FIG. 1. Note that exhaust port 15 is eccentric with respect to top wall 24 and is located near the edge of top wall 24. Immediately below exhaust port 15 and exhaust pipe 14 is blower 12 for introducing dry gas to drying chamber 10. Blower 12 is mounted to sidewall 16 as is shown in FIG. 3. Blower 12, as shown in the drawings, is a conventional electric squirrel cage blower. As mentioned previously, it may be preferable to provide a blower which has heating elements therein for heating of the drying gas prior to its introduction into the drying chamber 10. Even though blower 12 is of the squirrel cage variety it should be pointed out that other apparatuses may be used with the drying chamber of this invention so long as these apparatuses provide dry gas to the chamber and the introduction of gas is made at a point directly below exhaust port 15 and exhaust pipe 14. Generally speaking, blower 12 will be introducing dry air to the chamber. However, in those cases where gases other than air will be utilized as the drying gas, for example nitrogen, argon, etc., blower 12 will have its intake port in communication with these gases. This can be accomplished by placing blower 12 in another chamber which has an atmosphere which is exclusively the desired gas.

At approximately 90° from blower 12 there is provided door 20 which is held to annular sidewall 16 by means of hinges 22 and **22*a*. As mentioned previously, door 20 does not require elaborate sealing means as very little, if any, positive pressure will be built up within drying chamber 10**.

Figure 1:
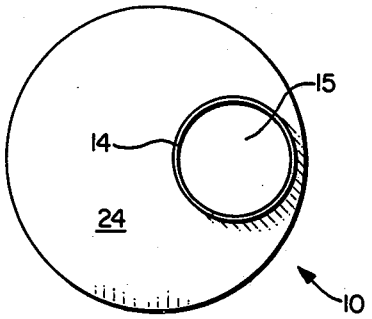
FIG. 1 is a top plan view of a drying chamber of this invention.
Figure 4:
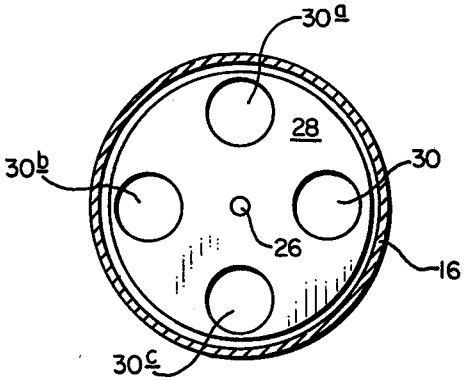
FIG. 4 is a sectional view taken through section lines 4—4 of FIG. 3.
Figure 5:
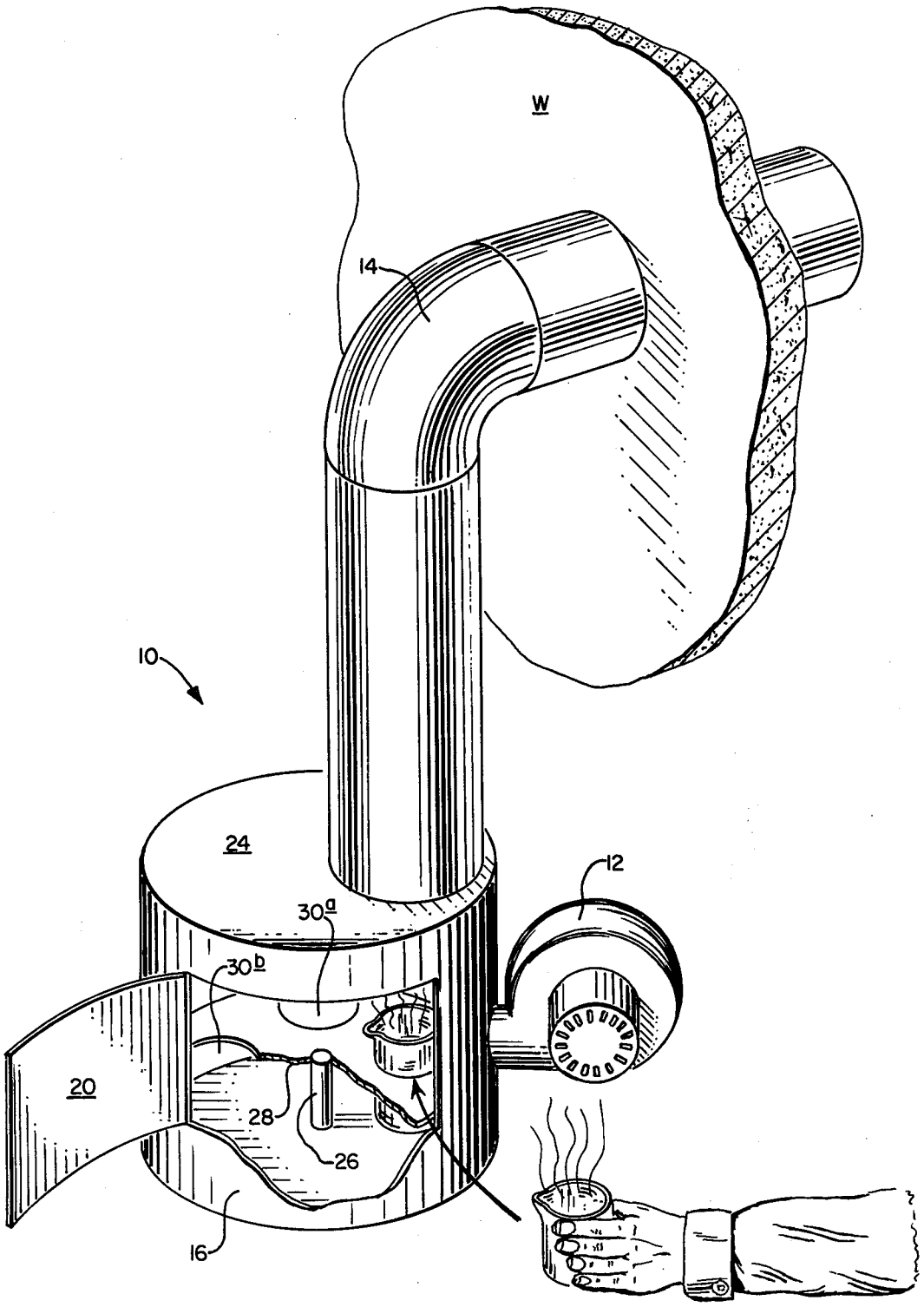
FIG. 5 is a partial, broken away perspective view of the drying chamber shown in FIG. 1.

Table 28 is provided for holding the material to be dried in close proximity to the dry gas which is introduced by blower 12. It is highly preferred that table 28 be a rotatable table so that all of the material introduced into drying chamber 10 will have exposure to the drying gas passed into the chamber. To achieve rotation, rotating table 28 is mounted upon spindle 26 which passes through bottom wall 18, as is shown in FIGS. 2 and 3. Spindle 26 can then be attached to an electric motor by means of a conventional pulley system to achieve the rotation of table 28. The pulley system and electric motor are not shown in the drawings. Also, when the material to be dried is contained in beakers, it has been found preferable that table 28 have holding apertures, 30, 30*a*, 30*b* and 30*c* as is shown in FIG. 4. Placement of the beakers in these apertures is shown in FIG. 5.

In some instances it may not be crucial to have a rotating table. In those cases a table may be utilized which is displaced from the bottom wall 18 by means of a plurality of downwardly depending pegs. It is important, however, that table 28, be it rotating or not, hold the material to be dried at a level approximately equal to the level at which the dry gas is introduced into drying chamber 10.

As mentioned previously, blower 12 may be provided with means for heating the drying gas prior to its introduction into drying chamber 10. When heating is so provided it may be desirable to have a thermometer placed in exhaust pipe 14 to monitor the temperature of the exhaust gas. Should the chamber become too warm, then the heat of the drying gas can be regulated downwardly or if the drying chamber becomes too cool the heat of the drying air can be adjusted upwardly.

The drying chamber of this invention should be constructed of materials which will not be corroded by the noxious fumes being given off as the material is being dried. For example, if hydrofluoric acid is given off as the drying of material proceeds then the drying chamber should be made of a material such as stainless steel. Determination of the exact materials of construction will be readily determined by those skilled in the art.

What is claimed is:

1. An apparatus for drying material which apparatus comprises:

a. a drying chamber which includes, i. a circular planar top wall having an eccentric exhaust port, ii. an annular sidewall downwardly depending from said top wall, said annular sidewall having an intake port radially located at a point beneath said exhaust port and said annular sidewall having an openable and closeable doorway for introducing said material to said drying chamber, and iii. a circular, planar bottom wall closing off the bottom of said annular sidewall;

b. holding means enclosed within said drying chamber holding said material at a level adjacent said intake port;

c. a blower for heating and introducing dry gas to the interior of said drying chamber through said intake port; and d. conduit means for routing exhaust gas from said drying chamber through said exhaust port to a disposal site.

2. The apparatus of claim 1 wherein said conduit means is a pipe and the ratio of the diameter of the chamber to the diameter of the exhaust port is within the range of from about 1.8:7 to about 2.2:8.5.

3. The apparatus of claim 1 wherein said gas is air.

* * * * *